US008876025B1

(12) United States Patent
Wheeler

(10) Patent No.: US 8,876,025 B1
(45) Date of Patent: Nov. 4, 2014

(54) VARIABLE FLOW SHOWERHEAD

(75) Inventor: Mary Wheeler, Overland Park, KS (US)

(73) Assignee: MJ Enterprises LLC, Overland Park, KS (US)

( * ) Notice: Subject to any disclaimer, the term of this patent is extended or adjusted under 35 U.S.C. 154(b) by 831 days.

(21) Appl. No.: 12/577,512

(22) Filed: Oct. 12, 2009

(51) Int. Cl.

| | |
|---|---|
| ***A47K 3/022*** | (2006.01) |
| ***A47K 3/28*** | (2006.01) |
| ***B05B 1/14*** | (2006.01) |
| ***B05B 1/16*** | (2006.01) |
| ***B05B 1/30*** | (2006.01) |

(52) U.S. Cl.
USPC ..... 239/569; 239/548; 239/443; 4/605; 4/615

(58) Field of Classification Search
CPC ..... A47K 3/022; A47K 3/28; B05B 1/14; B05B 1/16; B05B 1/30; A62C 2/08; A62C 37/08
USPC ..... 239/557, 555, 558, 548, 569, 578, 435, 239/443; 4/605, 615
See application file for complete search history.

(56) References Cited

U.S. PATENT DOCUMENTS

| | | | | |
|---|---|---|---|---|
| 4,998,673 | A * | 3/1991 | Pilolla | 239/67 |
| 5,025,516 | A * | 6/1991 | Wilson | 4/623 |
| 5,224,509 | A * | 7/1993 | Tanaka et al. | 137/315.03 |
| 5,829,072 | A * | 11/1998 | Hirsch et al. | 4/605 |
| 5,853,130 | A * | 12/1998 | Ellsworth | 239/548 |
| 5,855,356 | A * | 1/1999 | Fait | 251/129.04 |
| 2009/0293190 | A1 * | 12/2009 | Ringelstetter et al. | 4/605 |

* cited by examiner

*Primary Examiner* — Justin Jonaitis
(74) *Attorney, Agent, or Firm* — Lathrop & Gage LLP

(57) ABSTRACT

A showerhead operable to reduce water consumption configured to detect the presence of an individual within the spray pattern of water exiting the showerhead. The showerhead further includes a housing having an internal volume that is configured to receive and discharge water. A sensor is integrally mounted to the discharge surface of the housing and is operable to detect either the presence or absence of an individual within the spray pattern of water. A valve is disposed within the housing and is operable to control the water volume exiting the housing. The showerhead being operable to discharge substantially all of the water volume available thereto upon the detection of an individual within the spray pattern and further being operable to discharge a water volume that is less than the water volume available thereto to upon detection of an absence of an individual within the spray pattern.

20 Claims, 3 Drawing Sheets

VARIABLE FLOW SHOWERHEAD

FIELD OF THE INVENTION

The present invention relates to a water flow controlling plumbing fixture, more specifically but not by way of limitation, a showerhead having at least one sensor integrally mounted onto a portion thereof wherein the sensor is operable to detect an object within the water spray pattern exiting the showerhead. The sensor is further operably connected to a flow control valve wherein the water volume flow exiting the showerhead is altered based upon the detection or absence of an object within the water spray pattern exiting the showerhead.

BACKGROUND

Millions of individuals engage in the hygiene practice of taking a shower on a daily basis. Showers deliver an effective method of providing a means of cleansing oneself and offer an alternative to bathing in a tub. Individuals typically engage in routine tasks during showering such as but not limited to wetting hair or body, applying surfactant, shaving and rinsing. Unfortunately, the combination of any one of these tasks routinely requires the use of more water than if a person were to utilize a bathtub that was filled once with the desired amount of water.

One problem with existing shower heads is that they do not allow a user to control the flow of the water intermediate of performing any of the tasks mentioned herein thereby resulting in the waste of water. Typically, a user will remove themselves from the direct path of the water spray pattern or alter the angle of the shower head so that they are removed from the direct path of the water exiting the shower head so that they can perform a task such as apply a surfactant or shave. The water flow during these intermediate stages is not required to be a full-unrestricted flow. The result is that during a typical shower a user will not efficiently utilize the water volume provided and waste approximately thirty percent of the water volume during a shower.

Another issue with existing technologies is that the showerheads can not automatically control the flow of water based on the presence of an individual in the water path. Some existing shower heads have provided a flow control valve that either reduces or blocks the water flow but the valve must be engaged by hand by the user each time the user desires to reduce the flow and/or increase the flow. This can be very inconvenient to the user as individuals routinely have other objects disposed in their hands.

Accordingly there is a need for a showerhead that can automatically detect the presence of an individual in the path of the water stream exiting the showerhead and reduce and/or increase the water flow depending upon the detection of the presence or absence of an individual within the water stream.

SUMMARY OF THE INVENTION

It is the object of the present invention to provide a showerhead that can detect the presence of an individual within the path of the water stream exiting the showerhead.

It is a further object of the present invention to provide a showerhead that can detect the presence of an individual within the path of the water stream exiting the showerhead that utilizes either photo-sensor detectors such as laser or motion sensing LED's or passive infrared detectors.

Yet another object of the present invention is to provide a showerhead that includes a flow control valve operable to reduce or increase the water flow dependent upon the absence or presence of an individual within the water stream exiting the showerhead.

Still a further object of the present invention is to provide a showerhead that controls the flow of the water exiting the showerhead dependent upon the detection of an individual within the path of the water stream that includes a power supply.

Another object of the present invention is to provide a showerhead the either substantially reduces or shuts off the water flow exiting the showerhead upon detection of the absence of an individual within the path of the water stream exiting the shower head.

An additional object of the present invention is to provide a showerhead that detects and subsequently controls the water flow based upon the detection or absence of an individual within the water stream path exiting the shower head that is manufactured in numerous different sizes.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
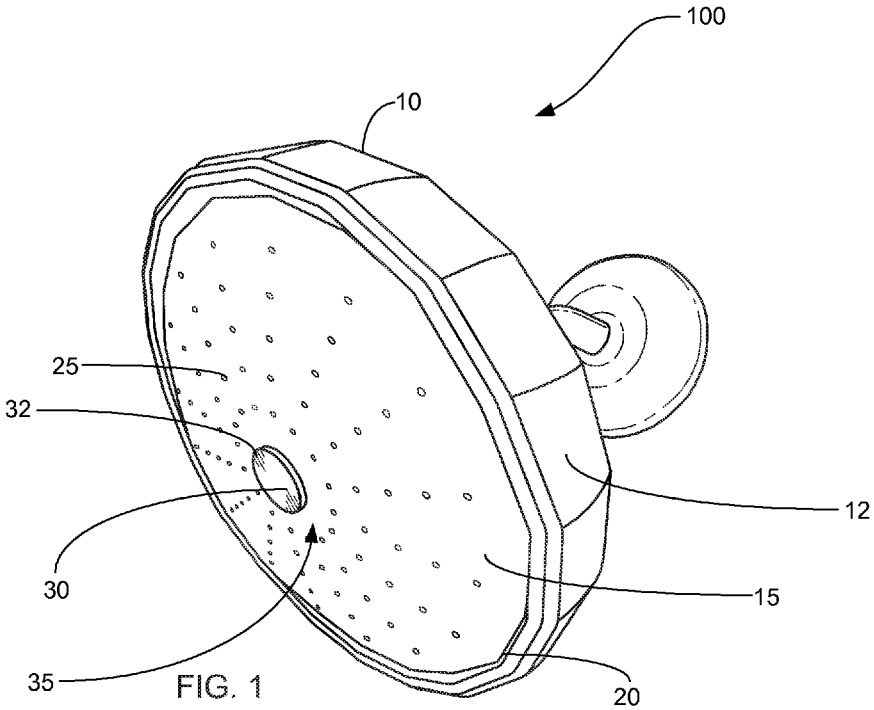
FIG. 1 is a perspective view of an embodiment of the present invention.

Referring now to the drawings submitted herewith, wherein various elements depicted therein are not necessarily drawn to scale and wherein throughout the views and figures like elements are referenced with identical reference numerals, there is illustrated a showerhead 100 constructed according to the principles of the present invention.

Referring in particular to FIG. 1 is a showerhead 100 that further includes a housing 10. The housing 10 is generally annular in shape and substantially hollow having an interior volume configured to receive and discharge fluid. The housing 10 is constructed of suitable durable material such as but not limited to metal. Although the housing 10 is illustrated herein in a generally annular shape, it is contemplated within the scope of the present invention that the housing 10 could be shaped in numerous different varieties. The housing 10 further includes a surface 15 that is integrally connected to the wall 12 in a generally perpendicular manner along the circumferential edge 20 of the surface 15. The surface 15 has journaled therethrough a plurality of apertures 25. The apertures 25 allow the water disposed within the housing 10 to exit the housing 10 in a desired pattern. While no specific water spray pattern is required, good results have been achieved utilizing a spray pattern that is generally annular in shape. Those skilled in the art should recognize that numerous different amounts and sizes of apertures 25 could be utilized on the surface 15 in order to create many different patterns of water streams exiting the showerhead 100.

Figure 3:
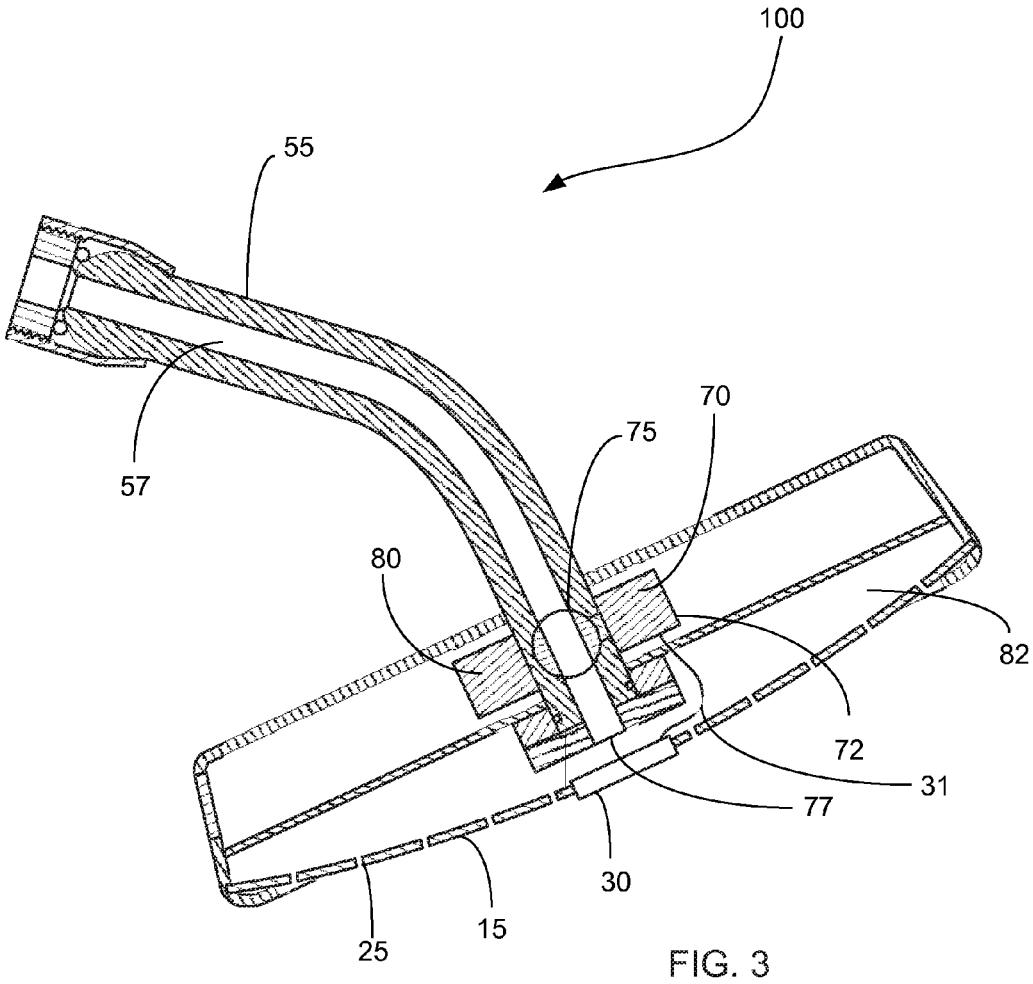
FIG. 3 is a cross-sectional view of an embodiment of the present invention.

Referring in particular to FIGS. 1 and 3, a sensor 30 is integrally mounted in generally the center portion 35 of the surface 15. The sensor 30 functions to detect the presence of an individual when they are present within the general diameter of the water spray pattern that is exiting from the apertures 25 of the surface 15 from the showerhead 100. The sensor 30 is operably connected to a controller 70 and ball valve 75 that function to control the water volume output through the apertures 25 in two modes. In a first mode, the sensor 30 detects the presence of an individual within the general diameter of the water spray pattern exiting the surface 15 and directs the controller 70 and ball valve 75 disposed within the showerhead 100 to allow the water volume exiting the apertures 25 to flow at substantially the full volume available to the showerhead 100.

In a second mode, subsequent to determining the absence of an individual in the general diameter of the water spray pattern exiting the surface 15, the sensor 30 functions to direct the controller 70 and ball valve 75 disposed within the showerhead 100 to reduce the water volume exiting the apertures 25 to a volume that is less than the volume that is being received from the water supply. While no specific water flow volume reduction is required, good results have been achieved by utilizing an eighty percent reduction of water flow in the second mode. Those skilled in the art will recognize that the water volume flow could be reduced by any amount between one hundred percent availability and complete restriction of water flow in the second mode of the showerhead 100. The sensor 30 further includes an outer covering 32 that constructed of a suitable durable translucent material such as but not limited to plastic. The outer covering 32 further functions to provide a waterproof seal to protect the sensor 30. While one sensor 30 is illustrated herein, it is contemplated that numerous different amounts and configurations of sensors 30 cold be utilized to achieve the desired functionality as described herein. More specifically but not by way of limitation, four sensors 30 could be mounted equidistant along the circumferential edge 20 so as to detect a user within the water flow path exiting the surface 15. Additionally, it is further contemplated within the scope of the present invention that the sensor 30 could be substantially disposed across the entire surface 15 and function to send a signal to the controller 70 to allow the water volume exiting the apertures 25 to be approximately equivalent to the portion of the surface 15 with which a user is in general alignment therewith. For example if a user is standing directly under the showerhead 100 the water flow exiting the apertures 25 would be at full availability and if a user is standing adjacent to the water stream path such that their body is only detected by twenty percent of the sensor 30 than the water flow exiting the apertures 25 would be approximately twenty percent of available volume.

Those skilled in the art will recognize that many different types of sensors 30 could be utilized to detect the presence of an individual within the general diameter of the water stream path exiting the surface 15. More specifically but not by way of limitation, the sensor 30 could be constructed from a radar-based motion sensor, passive infrared sensor or photo-sensor. As is known in the art radar-based motion sensors send out bursts of microwave radio energy or ultrasonic sound waves and then wait for the reflected energy to bounce back. If no user is detected within the general diameter of the water spray pattern exiting the surface 15, the radio energy will bounce back in the same pattern and the sensor 30 will function to direct the controller 70 and ball valve 75 within the showerhead 100 to reduce the water flow volume to an amount that is less than that of its supplied volume. Subsequent to a user being detected in the general diameter of the water spray pattern exiting the surface 15, the reflection pattern is disturbed. When this happens, the sensor 30 sends a signal to the controller 70 and ball valve 75 to permit the water flow volume to exit the surface 15 at its available full volume.

It is further contemplated that the sensor 30 could be constructed as a conventional photo-sensor utilizing a laser or LED light. As is known in the art a photo-sensor utilizes a focused source of light and a light sensor. In the present invention the focused light source would be disposed within the sensor 30 and a light sensor would be integrally mounted into a shower or bathtub floor. Subsequent the beam of light being generated from the sensor 30 being blocked by an individual being present in the general diameter of the water spray pattern exiting the surface 15 the light sensor would detect a decrease in light level from the sensor 30 and allow the showerhead to operate in its first mode as described herein. Additionally, when in use, the showerhead 100 would operate in its second mode when the light intensity is at its expected level thereby detecting the absence of a user within the general diameter of the water path exiting the surface 15.

It is further contemplated within the scope of the present invention that the sensor 30 could further be constructed from a conventional passive infrared detector and function to control the showerhead 100 in its first and second mode as described herein utilizing infrared energy detection.

Referring in particular to FIG. 3, a cross-sectional view of the showerhead 100 is illustrated therein. A pipe 55 is shown having a channel 57 therein. The pipe 55 is a conventional plumbing pipe that functions to operably connect the showerhead 100 to water source outlet typically available in a bathroom wall. The water flows through the channel 57 out the orifice 77 and into the chamber 82. Once present in the chamber 82 the water exits the apertures 25 journaled through the surface 15. A ball valve 75 is operably positioned within the channel 57. The ball valve 75 is a conventional electrically actuated ball valve that functions to control the water volume flow rate that propels outward from the orifice 77 into the chamber 82. The ball valve 75 is illustrated in FIG. 3 in a substantially closed position such that no water volume flow propagates into the chamber 82. As described herein, this position could be utilized to restrict the water flow exiting the apertures 25 in the second mode of the operation of the showerhead 100. While not illustrated herein it is contemplated within the scope of the present invention that the ball valve 75 could be replaced with a conventional three-way valve that is connected to a second pipe that is operably coupled to the hot water supply. In its preferred embodiment subsequent a user initially activating the showerhead 100 with the conventional fixtures, the showerhead 100 would detect its initial use and instead of dispensing water from the showerhead 100 the valve would be positioned such that the water would flow returning to the hot water supply. The water flow would remain in that direction until the controller 70 detected a water temperature passing through the valve reached temperature desirable to a user. At this stage the controller 70 would alter the position of the valve such that the water would now be dispensed from the showerhead 100.

Figure 4:
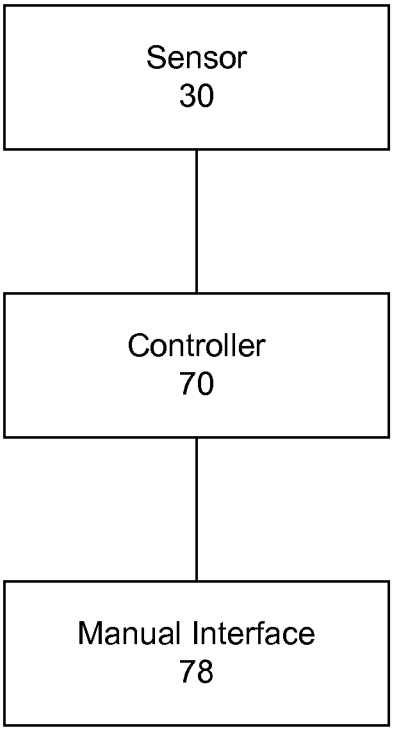
FIG. 4 is a block diagram of various components of the present invention, according to one embodiment.

A controller 70 is disposed within the showerhead 100 and is operably connected to the ball valve 75 and sensor 30. The controller 70 is housed in a waterproof body 72 and has disposed therein a conventional integrated circuit board that contains all of the electronics necessary to receive, store and manipulate signals from the sensor 30 in order to control the showerhead 100 in its first and second modes as described herein. The controller 70 is further operably connected to the sensor 30 by a wire 31. The wire 31 functions to transmit signals to the controller 70 when generated by the sensor 30. As shown in FIG. 4, it is further contemplated within the scope of the present invention that the controller 70 could have a manual interface 78 operably connected thereto and accessible from the exterior of the housing 10 such as but not limited to a dial. The manual interface 78 would allow a user to deactivate the controller 70 so the showerhead 100 would not function to detect the presence of a user in the water stream path and function as a conventional showerhead.

Figure 2:
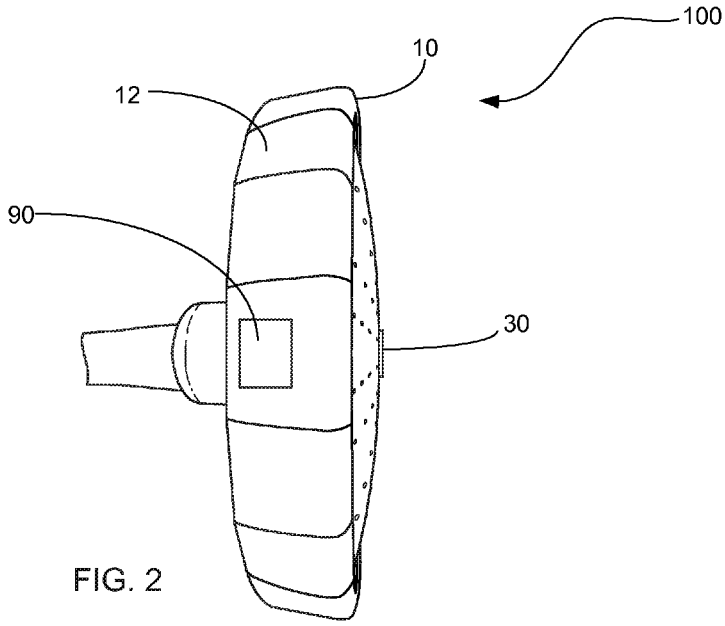
FIG. 2 is a side view of an embodiment of the present invention.

A power supply 80 is disposed within the showerhead 100. The power supply 80 is a conventional power supply that functions to provide the necessary power to the controller 70 and sensor 30. It is contemplated within the scope of the present invention that the power supply utilizes alkaline or lithium ion batteries to supply the power required to operate the showerhead 100. As shown in particular in FIG. 2, a hinged lid 90 is integrally mounted into the housing 10 to allow a user to access the power supply and replace batteries when required.

It is further contemplated within the scope of the present invention that the showerhead 100 could be configured with the necessary components to further control the water temperature exiting the apertures 25. More specifically but not by way of limitation, during the second mode as described herein, the showerhead 100 could further reduce the temperature of the water exiting the apertures 25. Additionally, it is contemplated within the scope of the present invention that the showerhead 100 could be configured with an alternate flow control device disposed within the chamber 82 along the surface 15 so as to control the opening and closing of the apertures 25 in order to provide a showerhead 100 capable of operating in the first and second mode as described herein by limiting the amount of apertures 25 from which water can exit.

Additionally contemplated within the scope of the present invention is that the manual interface 78 referenced herein could be configured so as to allow a user to program the controller 70 to control the desired water volume, temperature and duration for a plurality of different users each having different preferences for the parameters of water volume, temperature and duration of time for each mode as described herein. It is further contemplated within the scope of the present invention upon a user turning on the water source for the showerhead 100 that the controller 70 positions the ball valve 75 to allow approximately fifty percent of the available water volume to propel towards the orifice 77 so as to reduce water consumption while a user is waiting for the water to reach the desired temperature.

While the showerhead 100 as described herein is shown to have mounted therein the controller 70, ball valve 75, power supply 80, and sensor 30 all operably connected and functioning to control the operation of the showerhead in a first and second mode as described herein, it is further contemplated within the scope of the present invention that the controller 70, ball valve 75, power supply 80, and sensor 30 could be combined into a housing so as to interface with a standard shower pipe so as to convert a conventional showerhead and provide substantially all of the desired functionality as described herein. It should also be recognized by those skilled in the art that the controller 70, ball valve 75, power supply 80 and sensor 30 could be integrated into numerous types of plumbing fixtures.

A description of the operation of the showerhead 100 is as follows. Referring in particular to FIGS. 1 and 3, the showerhead 100 is connected to a desired water source utilizing the pipe 55. The user places batteries within the power supply 80 via the hinged lid 90. The water source is turned on using conventional plumbing fixtures to allow water to begin to flow to the showerhead 100. As the user engages the water spray pattern exiting the apertures 25 and is present within the general diameter of the water spray pattern the showerhead 100 functions in its first mode so as to allow substantially all of the available water volume to the showerhead 100 to exit the apertures 25. In this first mode, the sensor 30 detects the presence of a user within the general diameter of the water spray pattern and sends a signal to the controller 70 to position the ball valve 75 such that it is substantially open. When a user desires to perform a task wherein they only wish to engage a portion of the water spray pattern or be substantially removed from the water spray pattern, the sensor 30 detects the absence of the user from the general diameter of the water spray pattern exiting the apertures 25. Subsequent to detection of the absence of the user from the general diameter of the water spray pattern the sensor 30 sends a signal to the controller 70 to position the ball valve 75 such that it reduces the water volume exiting from of the orifice 77 of the channel 57 thereby reducing the water flow exiting the apertures 25.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A plumbing fixture, comprising:

a housing having a discharge surface operable to permit water to egress from an internal area;

a coupling portion for operably coupling the housing to a water supply;

at least one sensor operable to detect a portion of an area underneath the housing which is occupied;

a controller configured to operate in a first mode receiving signals from the at least one sensor and altering an amount of water permitted to egress from the internal area such that:

(a) when the detected portion of the area underneath the housing which is occupied is above a predetermined threshold, the amount of water permitted to egress from the internal area is proportional to the detected portion of the area underneath the housing which is occupied; and (b) when the detected portion of the area underneath the housing which is occupied is below the predetermined threshold, a predetermined amount of water is permitted to egress from the internal area; and an input device for overriding the first mode and allowing a maximum amount of water to egress from the internal area.

2. The plumbing fixture of claim 1, wherein the controller is located within the housing.

3. The plumbing fixture of claim 1, wherein the at least one sensor is selected from the group consisting of: a photosensor, a radar-based motion sensor, and a passive infrared sensor.

4. The plumbing fixture of claim 1, wherein the plumbing fixture is a showerhead.

5. The plumbing fixture of claim 4, further comprising at least one valve in communication with the controller for altering the amount of water permitted to egress from the internal area.

6. The pluming fixture of claim 5, further including a temperature sensor, the temperature sensor being operable to measure temperature of water entering the valve, the temperature sensor being operably coupled to the controller whereby the showerhead is permitted to operate in the first mode only after the water entering the valve reaches a predetermined temperature.

7. The plumbing fixture of claim 6, wherein the controller is located within the housing.

8. The plumbing fixture of claim 7, wherein the at least one sensor is selected from the group consisting of: a photosensor, a radar-based motion sensor, and a passive infrared sensor.

9. The plumbing fixture of claim 8, further including a DC power supply electrically coupled to the at least one sensor and the controller.

10. The plumbing fixture of claim 9, wherein the sensor is integrally mounted to the discharge surface.

11. A plumbing fixture, comprising:

a housing having a discharge surface operable to permit water to egress from an internal area;

a coupling portion for operably coupling the housing to a water supply;

at least one sensor operable to detect a portion of an area underneath the housing which is occupied; and a controller configured to operate in a first mode receiving signals from the at least one sensor and altering an amount of water permitted to egress from the internal area such that the amount of water permitted to egress from the internal area is directly proportional to the detected portion of the area underneath the housing which is occupied.

12. The plumbing fixture of claim 11, wherein the plumbing fixture is a showerhead.

13. The plumbing fixture of claim 11, further comprising at least one valve in communication with the controller for altering the amount of water permitted to egress from the internal area.

14. The plumbing fixture of claim 13, further including a temperature sensor, the temperature sensor being operable to measure temperature of water entering the valve, the temperature sensor being operably coupled to the controller whereby the showerhead is permitted to operate in the first mode only after the water entering the valve reaches a predetermined temperature.

15. The plumbing fixture of claim 14, wherein the controller is located within the housing.

16. The plumbing fixture of claim 15, wherein the at least one sensor is selected from the group consisting of: a photosensor, a radar-based motion sensor, and a passive infrared sensor.

17. The plumbing fixture of claim 16, further including a DC power supply electrically coupled to the at least one sensor and the controller.

18. The plumbing fixture of claim 17, wherein the sensor is integrally mounted to the discharge surface.

19. A plumbing fixture, comprising:

a housing having a discharge surface operable to permit water to egress from an internal area;

a coupling portion for operably coupling the housing to a water supply;

at least one sensor operable to detect a portion of an area underneath the housing which is occupied;

a controller configured to operate in a first mode receiving signals from the at least one sensor and altering an amount of water permitted to egress from the internal area such that the amount of water permitted to egress from the internal area is proportional to the detected portion of the area underneath the housing which is occupied; and an input device for overriding the first mode and allowing a maximum amount of water to egress from the internal area.

20. The plumbing fixture of claim 19, wherein the plumbing fixture is a showerhead.

* * * * *